US010946394B2

(12) United States Patent
Hu et al.

(10) Patent No.: US 10,946,394 B2
(45) Date of Patent: Mar. 16, 2021

(54) SHOWER HEAD WATER-SAVING SWITCHING STRUCTURE AND SHOWER HEAD

(71) Applicant: Purity (Xiamen) Sanitary Ware Co., Ltd., Fujian (CN)

(72) Inventors: Dongming Hu, Xiamen (CN); Ruiyin Ye, Xiamen (CN); Xingchuan Ling, Xiamen (CN); Guozhong Wu, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 105 days.

(21) Appl. No.: 16/226,638

(22) Filed: Dec. 20, 2018

(65) Prior Publication Data

US 2020/0197962 A1 Jun. 25, 2020

(51) Int. Cl.

| | |
|---|---|
| ***B05B 1/18*** | (2006.01) |
| ***B05B 1/12*** | (2006.01) |
| ***B05B 12/00*** | (2018.01) |
| ***B05B 1/30*** | (2006.01) |
| ***B05B 1/16*** | (2006.01) |

(52) U.S. Cl.

CPC ..... *B05B 1/18* (2013.01); *B05B 1/12* (2013.01); *B05B 1/1636* (2013.01); *B05B 1/30* (2013.01); *B05B 12/002* (2013.01)

(58) Field of Classification Search

CPC ..... B05B 1/1609; B05B 1/1636; B05B 1/185; B05B 1/30; B05B 1/3026; B05B 1/16; B05B 1/1627; B05B 1/1663

USPC ..... 239/436–499

See application file for complete search history.

(56) References Cited

U.S. PATENT DOCUMENTS

| | | | | |
|---|---|---|---|---|
| 3,109,314 | A * | 11/1963 | Nobuo | B41B 21/34 74/152 |
| 4,143,821 | A * | 3/1979 | Aghnides | B05B 1/083 239/381 |
| 4,921,002 | A * | 5/1990 | Christon | A01G 25/162 137/119.03 |
| 5,433,384 | A * | 7/1995 | Chan | B05B 1/1636 239/239 |
| 5,727,591 | A * | 3/1998 | Doll | F16K 31/105 137/554 |
| 5,819,789 | A * | 10/1998 | Schneider | F16K 3/08 137/454.5 |
| 5,871,296 | A * | 2/1999 | Furukawa | B43K 5/1881 401/106 |
| 6,233,758 | B1 * | 5/2001 | Jeong | B05B 1/302 4/615 |

(Continued)

*Primary Examiner* — Viet Le

(74) *Attorney, Agent, or Firm* — Leong C. Lei

(57) ABSTRACT

A shower head water-saving switching structure and a shower head are disclosed. The shower head water-saving switching structure includes a water inlet seat, a water discharging body, a functional water switching member, a flow switching member, and a drive mechanism. The water inlet seat and the water discharging body are connected to form a water distribution chamber therebetween. The drive mechanism includes a ratchet wheel, a push rod in linked with the ratchet wheel, and a button linked with the push rod. The functional water switching member and the flow switching member are rotatably accommodated in the water distribution chamber and linked with the ratchet wheel. The structure is simple, and the operation is effortless.

9 Claims, 6 Drawing Sheets

(56) References Cited

U.S. PATENT DOCUMENTS 6,367,710 B2 * 4/2002 Fan ..... B05B 1/1636 239/381
6,612,507 B1 * 9/2003 Meyer ..... A46B 11/06 239/394
6,738,996 B1 * 5/2004 Malek ..... B05B 1/1618 239/441
6,755,204 B2 * 6/2004 Herbert ..... F16K 11/166 137/1
7,070,125 B2 * 7/2006 Williams ..... B05B 1/1618 239/443
7,818,828 B2 * 10/2010 Zhou ..... B05B 1/1663 137/883
7,988,070 B1 * 8/2011 Yang ..... B05B 1/18 239/116
8,066,203 B2 * 11/2011 Zhou ..... B05B 1/1636 239/443
8,113,442 B2 * 2/2012 Li ..... B05B 1/18 239/11
9,022,057 B2 * 5/2015 Zink ..... B05B 1/3006 137/240
9,199,252 B2 * 12/2015 Schorn ..... B05B 1/1681
9,394,259 B2 * 7/2016 Zhou ..... B05B 1/1636
9,427,749 B2 * 8/2016 Zhou ..... B05B 1/1636
9,470,334 B2 * 10/2016 Zhou ..... F16K 31/44
9,545,639 B2 * 1/2017 Meehan ..... B05B 1/1627
9,616,434 B2 * 4/2017 Pan ..... B05B 1/1636
9,714,502 B2 * 7/2017 Huang ..... E03C 1/0405
9,776,196 B2 * 10/2017 Yu ..... A47K 3/28
9,795,974 B2 * 10/2017 Zhou ..... B05B 1/18
9,829,116 B2 * 11/2017 Xu ..... F16K 31/535
9,895,702 B2 * 2/2018 Lei ..... B05B 1/12
9,901,939 B2 * 2/2018 Lin ..... B05B 1/1636
10,058,878 B2 * 8/2018 Hu ..... B05B 1/1636
10,179,337 B2 * 1/2019 Lin ..... B05B 1/1636
2005/0258274 A1 * 11/2005 Wang ..... B05B 1/1636 239/393
2006/0219822 A1 * 10/2006 Miller ..... B05B 1/30 239/562
2009/0194613 A1 * 8/2009 Mang ..... B05B 1/3026 239/562
2009/0288250 A1 * 11/2009 Zhou ..... B05B 1/1636 4/615
2010/0139798 A1 * 6/2010 Schooley, Jr. ..... B05B 1/18 137/893
2010/0148104 A1 * 6/2010 Ho-Yeong ..... E03C 1/055 251/209
2010/0264237 A1 * 10/2010 Engel ..... B05B 1/185 239/443
2010/0320295 A1 * 12/2010 Mang ..... B05B 1/18 239/562
2012/0111973 A1 * 5/2012 Cheng ..... E03C 1/0409 239/214
2012/0259282 A1 * 10/2012 Alderete, Jr. ..... A61M 5/16831 604/131
2012/0267453 A1 * 10/2012 Devaney ..... A62C 31/28 239/288.5
2012/0305116 A1 * 12/2012 Zhou ..... B05B 1/169 137/625.46
2013/0015269 A1 * 1/2013 Zhou ..... B05B 12/0022 239/437
2013/0247294 A1 * 9/2013 Zhou ..... B05B 1/18 4/615
2013/0284823 A1 * 10/2013 Zhou ..... B05B 1/18 239/438
2014/0027234 A1 * 1/2014 Zhou ..... B05B 1/1636 192/43.1
2014/0182691 A1 * 7/2014 James ..... F16K 31/04 137/3
2014/0339332 A1 * 11/2014 Bartelick ..... F24C 14/005 239/195
2015/0224519 A1 * 8/2015 Buhler ..... B05B 1/185 239/443
2016/0167062 A1 * 6/2016 Pan ..... B05B 1/1654 239/442
2016/0221006 A1 * 8/2016 Lin ..... B05B 1/169
2016/0310972 A1 * 10/2016 Lin ..... B05B 1/1636
2016/0325291 A1 * 11/2016 Zhou ..... B05B 1/1654
2017/0056897 A1 * 3/2017 Xu ..... F16K 11/074
2017/0100727 A1 * 4/2017 Lin ..... B05B 1/1636
2017/0100728 A1 * 4/2017 Gong ..... B05B 1/18
2017/0136473 A1 * 5/2017 Yu ..... A47K 3/28
2017/0320084 A1 * 11/2017 Lin ..... B05B 1/1627
2018/0029049 A1 * 2/2018 Hu ..... B05B 1/18
2018/0051816 A1 * 2/2018 Lin ..... B05B 12/002

* cited by examiner

SHOWER HEAD WATER-SAVING SWITCHING STRUCTURE AND SHOWER HEAD

BACKGROUND OF THE INVENTION

1. Field of the Invention

The present invention relates to sanitary ware, and more particularly to a shower head water-saving switching structure and a shower head.

2. Description of the Prior Art

With the improvement of living standards, the requirements for shower heads are getting higher. Therefore, most people purchase shower heads with multiple functional water choices. Through a switching operation, the spray mode of the shower head can be controlled.

In order to facilitate the operation of the spray mode of the shower head, a switchable shower head with a button is developed. The button is used for switching the spray mode of the shower head. By pressing the button of the switchable shower head, a switching disk located in a water distribution chamber of the shower head is driven to rotate for a water distribution opening of the switching disk to communicate with one of the functional water chambers of the shower head, thereby realizing functional water switching.

There is no need to spray a large amount of water when the user applies shower gel and shampoo in the shower process. At this time, the shower is in a large flow mode, and the water is wasted. For the switchable shower head, if the effluent water flow of the shower head is controlled by controlling the communication area between the water distribution opening of the switching disk and the water inlet of the functional water chamber of the shower head, the influent water flow of the switchable shower head acts on the switching disk along the axial direction of the rotation of the switching disk. When the communication area between the water distribution opening of the switching disk and the water inlet of the functional water chamber of the shower head is small, the force of the influent water flow to the switching disk is the largest, and the friction resistance is large when the switching disk is rotated. At this time, it requires a large force to press the button to drive the switching disk to rotate, which is very laborious. The existing switchable shower head generally controls the effluent water flow of the shower head by adding a flow control assembly, which makes the structure of the switchable switch shower more complicated. Besides, the user needs to control the effluent water flow and the spray mode of the shower head via two buttons. The cost is high. Accordingly, the inventor of the present invention has devoted himself based on his many years of practical experiences to solve these problems.

SUMMARY OF THE INVENTION

The primary object of the present invention is to provide a shower head water-saving switching structure and a shower, which has the advantages of simple operation and labor saving.

In order to achieve the above object, the present invention adopts the following technical solutions.

According to one aspect of the present invention, a shower head water-saving switching structure is provided. The shower head water-saving switching structure comprises a water inlet seat having a water inlet passage, a water discharging body having a plurality of functional water chambers, a functional water switching member, a flow switching member, and a drive mechanism. A water distribution chamber is formed between the water inlet seat and the water discharging body. The water distribution chamber is provided with a side water inlet communicating with the water inlet passage. An inner bottom wall of the water distribution chamber is provided with a plurality of functional water chamber water inlets communicating with the respective functional water chambers. The drive mechanism includes a ratchet wheel that is rotatably fitted on a top surface of the water inlet seat, a push rod that is movably fitted on the top surface of the water inlet seat, and a button that is movably fitted on the water inlet seat. The push rod links and cooperates with the ratchet wheel. A return spring is provided between the push rod and the water inlet seat for moving the push rod back. The button links and cooperates with the push rod. The functional water switching member includes a water distribution gear that is rotatably accommodated in the water distribution chamber. The water distribution gear is coaxially connected with the ratchet wheel through a rotating shaft that passes through the water distribution chamber. A bottom surface of the water distribution gear abuts against the inner bottom wall of the water distribution chamber. The water distribution gear is provided with a water distribution opening selectively communicating with one of the functional water chamber water inlets. The flow switching member includes a drive gear that is rotatably accommodated in the water distribution chamber and a flow limit post. The drive gear is meshed with the water distribution gear. The flow limit post is connected to the drive gear. A side wall of the flow limit post is provided with a flow limit protruding block corresponding to the side water inlet. The drive mechanism drives the water distribution gear to rotate, so that the water distribution opening of the water distribution gear selectively communicates with one of the functional water chamber water inlets. The water distribution gear drives the drive gear and the flow limit post to rotate, so that an overlapping area of the flow limit protruding block of the flow limit post and the side water inlet is increased or decreased, thereby controlling water flow passing through the side water inlet.

Preferably, an inner top wall of the water distribution chamber is provided with a recess. A side wall of the recess is provided with the side water inlet. The flow limit post is inserted into the recess.

Preferably, the flow limit post and the drive gear are disposed coaxially. A center of a top of the recess is provided with a first positioning post. A top of the flow limit post is provided with a first positioning hole for receiving the first positioning post. A center of a bottom surface of the drive gear is provided with a second positioning post protruding downwardly. The inner bottom wall of the water distribution chamber is provided with a second positioning hole for receiving the second positioning post.

Preferably, a guiding block is formed on the top surface of the water inlet seat. The guiding block is provided with a guiding hole. The push rod is movably inserted through the guiding hole. One side of the push rod is provided with a push block that is movably engaged with teeth of the ratchet wheel. Another side of the push rod is provided with a baffle. Two ends of the return spring abut against the baffle and the guiding block, respectively. The button is hingedly connected to the water inlet seat. A swing block is hingedly connected to the water inlet seat. One end of the swing block abuts against the button, and another end of the swing block abuts against an end of the push rod.

Preferably, one side of the push rod is provided with a lateral mounting groove. The push block is movably inserted into the lateral mounting groove. A push block spring is disposed between the push block and a wall of the lateral mounting groove.

Preferably, one side of the baffle, facing the guiding block, is provided with a protruding post. The return spring is fitted on the protruding post.

Preferably, the top surface of the water inlet seat is provided with a check pawl to prevent the ratchet wheel from rotating reversely.

Preferably, the inner bottom wall of the water distribution chamber is provided with a drain opening communicating with one of the functional water chambers. When the overlapping area of the flow limit protruding block of the flow limit post and the side water inlet is maximum, the water distribution opening of the water distribution gear communicates with the dram opening.

According to another aspect of the present invention, a shower head is provided. The shower head comprises a shower head body and the shower head water-saving switching structure described above. The shower head body has a head portion and a handle portion connected to the head portion. A water inlet pipe is mounted in the handle portion. The shower head water-saving switching structure is mounted in the head portion of the shower head body. The water inlet passage communicates with the water inlet pipe.

After adopting the above solutions, the present invention has the following advantages:

1. The shower head water-saving switching structure of the present invention can drive the functional water switching member to rotate and control the water distribution opening of the water distribution gear to communicate with one of the different functional water chamber water inlets by pressing the button, thereby realizing the functional water switching function. The flow switching member can be driven to rotate by pressing the button, so that the overlapping area of the flow limit protruding block and the side water inlet increases or decreases, thereby controlling the flow of the water passing through the side water inlet, thereby realizing the flow switching function. The button is a dual-functional button, so that the shower head water-saving switching structure of the present invention is simplified and the operation is simple.

2. The shower head water-saving switching structure of the present invention controls the flow of the water passing through the side water inlet by means of the cooperation of the flow limit protruding block and the side water inlet, thereby controlling the water flow in the water distribution chamber, so that the discharging flow of the shower head water-saving switching structure of the present invention can be controlled to realize flow switching. Thus, when the influent water flow of the side water inlet is small, the water flow in the water distribution chamber is correspondingly reduced, so that the effluent water flow of the shower head water-saving switching structure of the present invention is reduced. At this time, the water pressure in the water distribution chamber does not increase, so that the frictional force applied to the water distribution gear does not increase, and the force required to press the button is not increased. The operation of the shower head water-saving switching structure of the present invention can be more effortless.

3. The shower head of the present invention has the shower head water-saving switching structure of the present invention disposed on the shower head body. The structure is simple, and the operation is effortless.

DETAILED DESCRIPTION OF THE PREFERRED EMBODIMENTS

Figure 1:
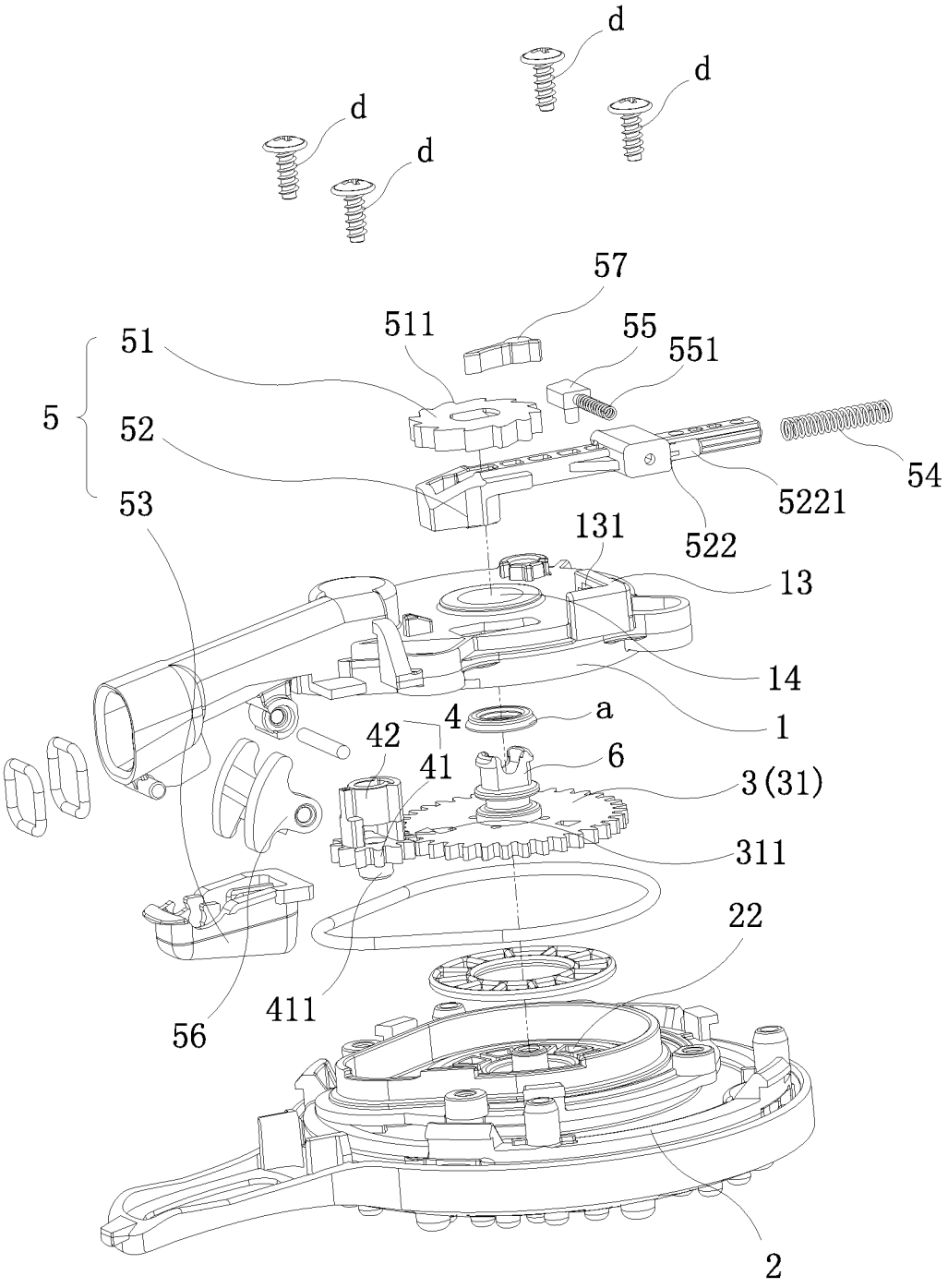
FIG. 1 is an exploded view of the shower head water-saving switching structure of the present invention.

Embodiments of the present invention will now be described, by way of example only, with reference to the accompanying drawings.

As shown in FIG. 1 to FIG. 8, the present invention discloses a shower head water-saving switching structure, which includes a water inlet seat 1 having a water inlet passage 11, a water discharging body 2 having a plurality of functional water chambers 21, a functional water switching member 3, a flow switching member 4, and a drive mechanism 5.

As shown in FIG. 1 to FIG. 5, the water inlet seat 1 and the water discharging body 2 are connected by screws d. A water distribution chamber A is formed between the water inlet seat 1 and the water discharging body 2. The inner top wall of the water distribution chamber A is provided with a recess 12. The recess 12 may be located on the water inlet seat 1. The side wall of the recess 12 is provided with a side water inlet 121 communicating with the water inlet passage 11. The inner bottom wall of the water distribution chamber A is provided with a plurality of functional water chamber water inlets 22 communicating with the respective functional water chambers 21. The functional water chamber water inlets 22 may be disposed on the water discharging body 2. The water inlet seat 1 and the water discharging body 2 are not limited to being connected by the screws d. The water inlet seat 1 and the water discharging body 2 may be connected by screw threads or snapping or welding.

Figure 2:
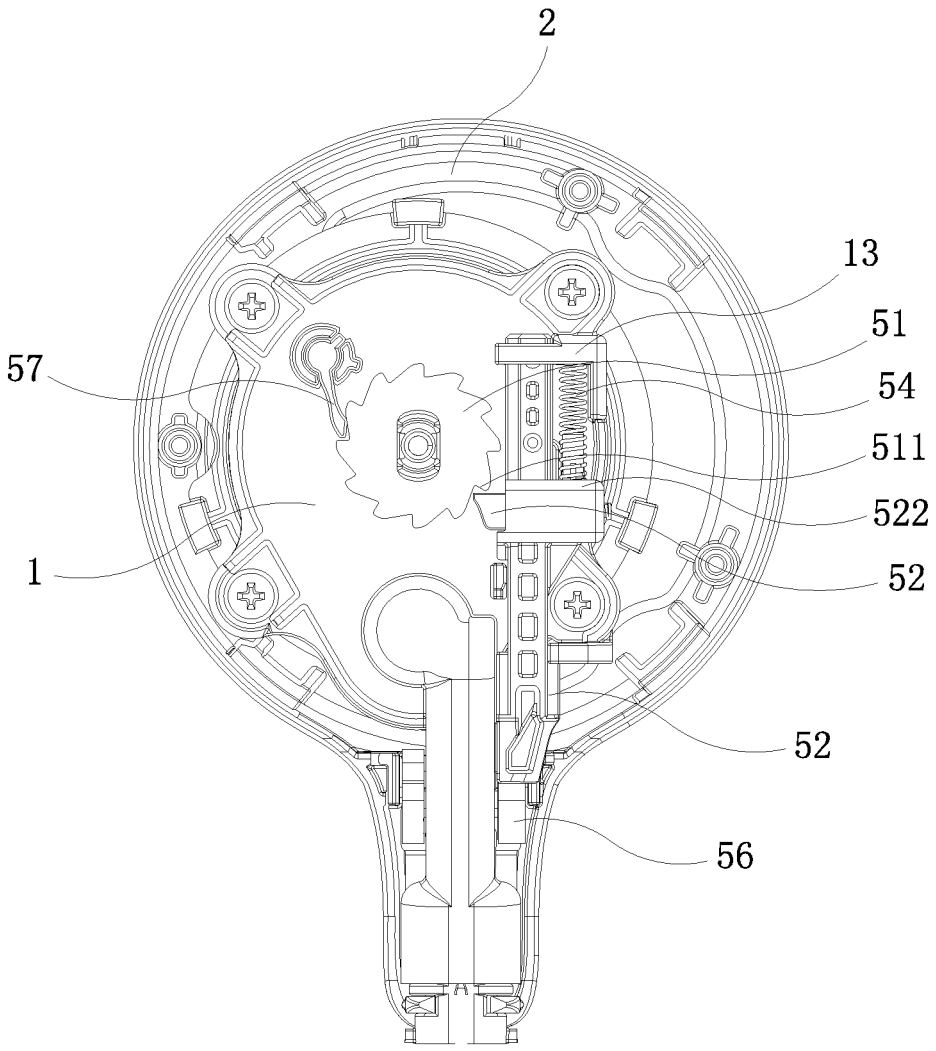
FIG. 2 is an assembled view of the shower head water-saving switching structure of the present invention.
Figure 3:
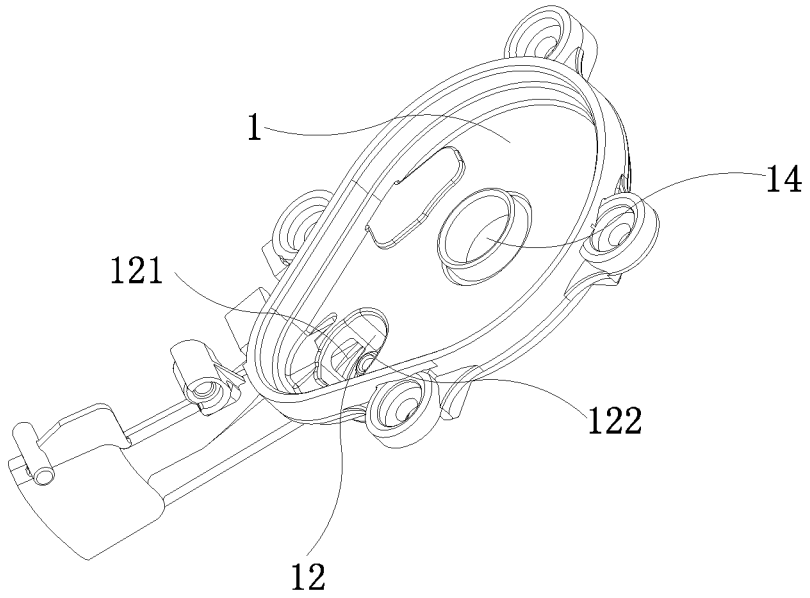
FIG. 3 is a structural schematic view of the water inlet seat of the present invention.
Figure 4:
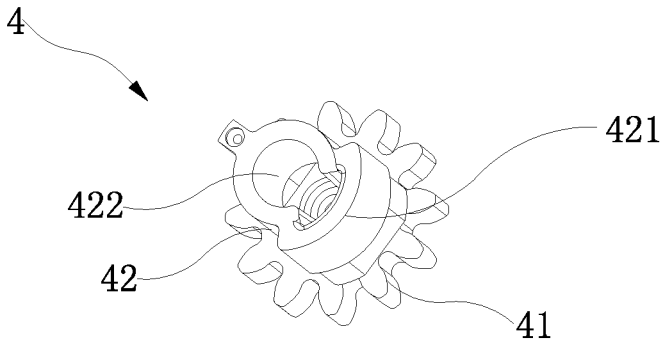
FIG. 4 is a structural schematic view of the flow switching member of the present invention.
Figure 7:
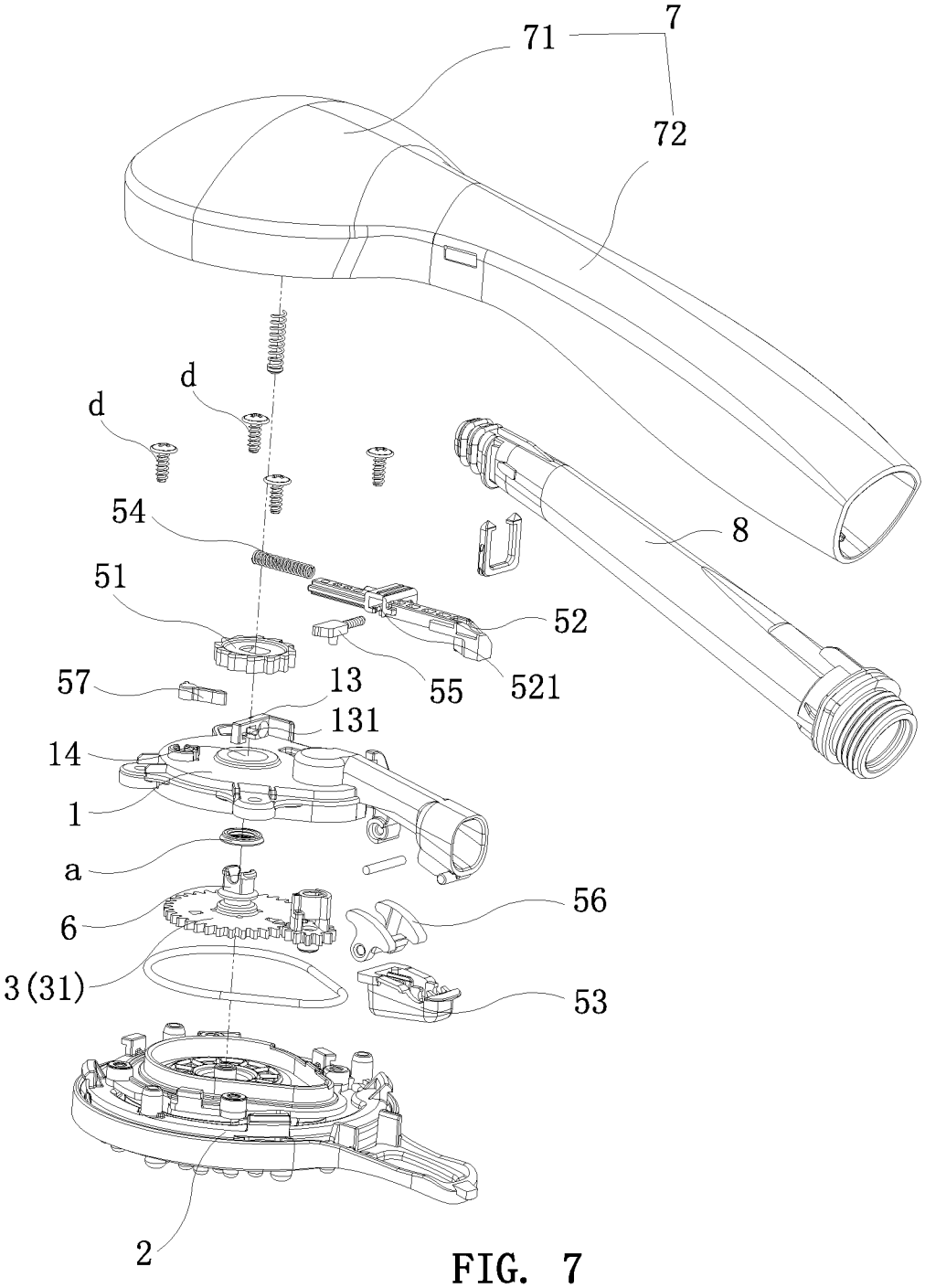
FIG. 7 is an exploded view of the shower head of the present invention.

As shown in FIGS. 1, 2 and 7, the drive mechanism 5 includes a ratchet wheel 51, a push rod 52, and a button 53. The ratchet wheel 51 is rotatably fitted on the top surface of the water inlet seat 1. The push rod 52 is movably fitted on the top surface of the water inlet seat 1. The push rod 52 links and cooperates with the ratchet wheel 51. A return spring 54 is disposed between the push rod 52 and the water inlet seat 11 for moving the push rod 52 back. The button 53 is movably fitted on the water inlet seat 1 and links and cooperates with the push rod 2. A guiding block 13 is formed on the top surface of the water inlet seat 1. The guiding block 13 is provided with a guiding hole 131. The push rod 52 is movably inserted through the guiding hole 131 to guide the movement of the push rod 52. One side of the push rod 52 is provided with a lateral mounting groove 521. A push block 5 is movably inserted into the lateral mounting groove 521 and movably engaged with teeth 511 of the ratchet wheel 5, so that the push rod 52 links and cooperates with the ratchet wheel 51. A push block spring 551 is disposed between the push block 55 and the wall of the lateral mounting groove 521 to ensure that the push block 55 can engage with the teeth 511 of the ratchet wheel 51. Another side of the push rod 52 is provided with a baffle 52. Two ends of the return spring 54 abut against the baffle 522 and the guiding block 13, respectively. In order to prevent the displacement of the return spring 54, one side of the baffle 522, facing the guiding block 13, is provided with a protruding post 5221. The return spring 54 is fitted on the protruding post 521. The button 53 is hingedly connected to the water inlet seat 1. A swing block 56 is hingedly connected to the water inlet seat 1. One end of the swing block 56 abuts against the button 53, and another end of the swing block 56 abuts against an end of the push rod 52. Thus, by pressing the button 53, the button 53 can push the push rod 52 to move via the swing block 56. For the ratchet wheel 51 to rotate in the forward direction only, the top surface of the water inlet seat 1 is provided with a check pawl 57 to prevent the ratchet wheel 51 from rotating reversely.

Figure 8:
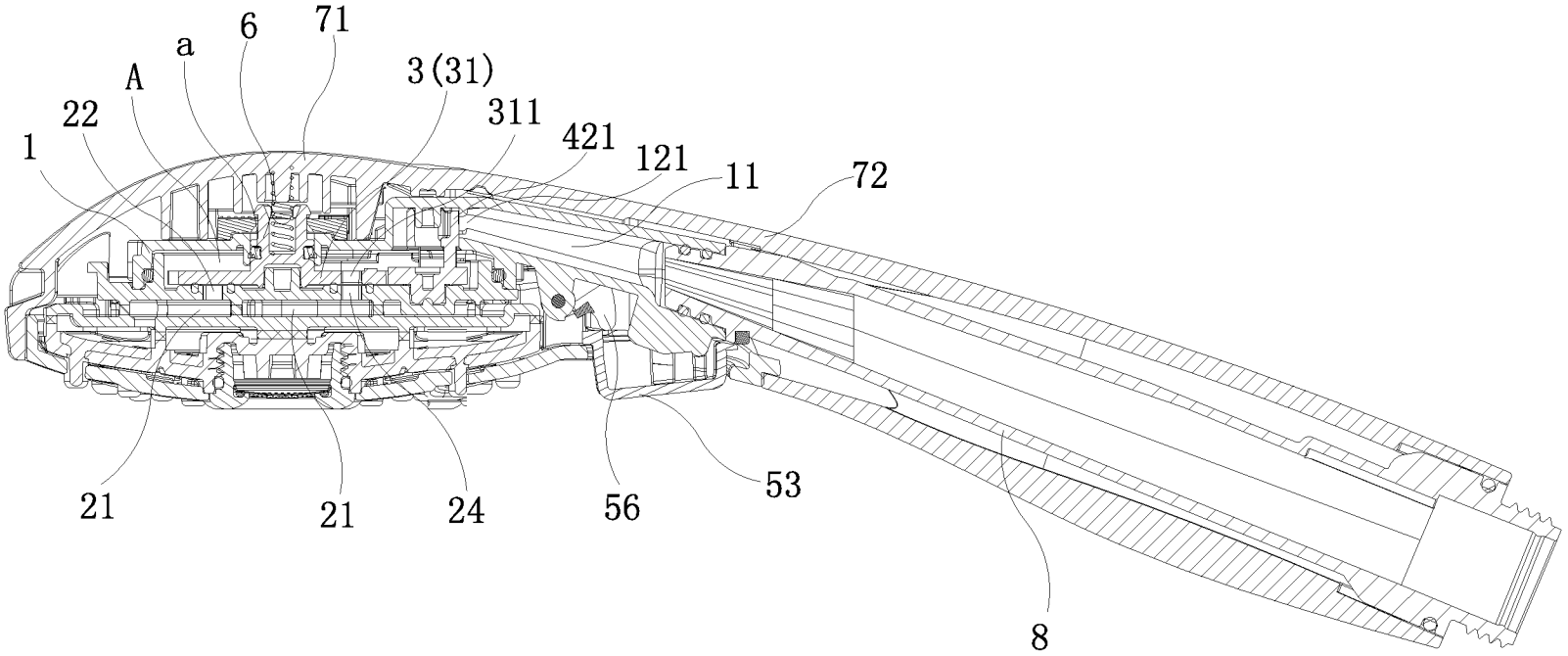
FIG. 8 is a cross-sectional view of the shower head of the present invention.

As shown in FIG. 1 and FIG. 8, the functional water switching member 3 includes a water distribution gear 31 that is rotatably accommodated in the water distribution chamber A. The water distribution gear 31 is coaxially connected with the ratchet wheel 51 through a rotating shaft 6 that passes through the water distribution chamber A. The bottom surface of the water distribution gear 31 abuts against the inner bottom wall of the water distribution chamber A. The water distribution gear 31 is provided with a water distribution opening 311 selectively communicating with one of the functional water chamber water inlets 22. Rotating the water distribution gear 31 allows the water distribution opening 311 of the water distribution gear 31 to selectively communicate with one of the functional water chamber water inlets 22 so as to realize functional water switching. A through hole 14 is formed in the water inlet seat 1 for the rotating shaft 6 to pass therethrough. A sealing ring a is provided between the rotating shaft 6 and the through hole 14 to ensure watertightness. The rotating shaft 6 may be integrally formed with the water distribution gear 31. The upper end of the rotating shaft 6 is connected to the center of the ratchet wheel 5.

Figure 5:
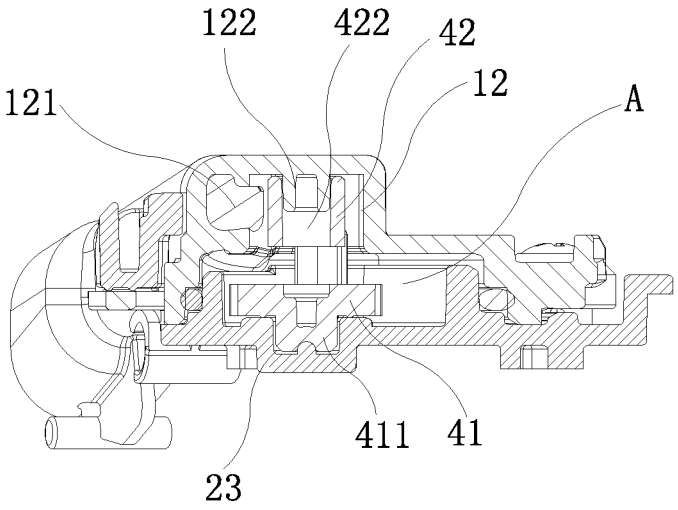
FIG. 5 is a cross-sectional view of the shower head water-saving switching structure of the present invention in a large discharge state.
Figure 6:
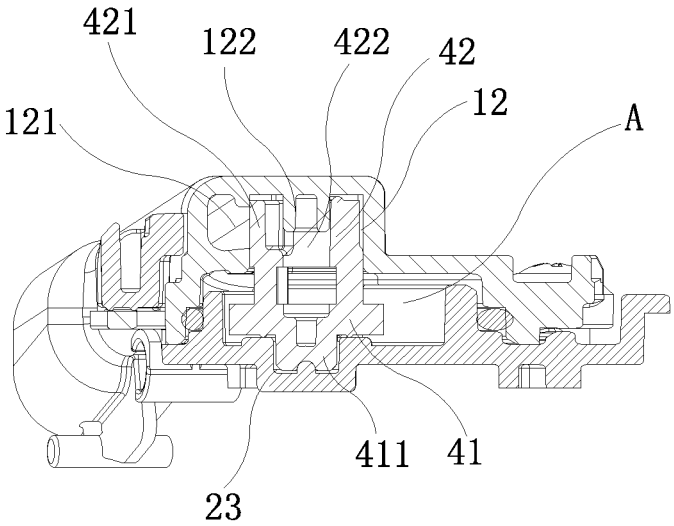
FIG. 6 is a cross-sectional view of the shower head water-saving switching structure of the present invention in a small discharge state.

As shown in FIG. 1, FIG. 4, FIG. 5, FIG. 6 and FIG. 8, the flow switching member 4 includes a drive gear 41 that is rotatably accommodated in the water distribution chamber A and a flow limit post 42. The drive gear 41 is meshed with the water distribution gear 31. The flow limit post 42 is connected to the top surface of the drive gear 41. The flow limit post 42 is inserted into the recess 12. The side wall of the flow limit post 42 is provided with a flow limit protruding block 421 corresponding to the side water inlet 121. As shown in FIG. 5 and FIG. 6, when the flow limit post 42 is rotated, the overlapping area of the flow limit protruding block 421 of the flow limit post 42 and the side water inlet 121 increases or decreases to control the flow of the water passing through the side water inlet 121, thereby controlling the water flow in the water distribution chamber A. In this way, the discharging flow of the shower head water-saving switching structure of the present invention can be controlled to realize flow switching. As shown in FIG. 5, when the overlapping area of the flow limit protruding block 421 and the side water inlet 121 is small, the shower head water-saving switching structure of the present invention is in a large discharge state. As shown in FIG. 6, when the overlapping area of the flow limit protruding block 421 and the side water inlet 121 is large, the shower head water-saving switching structure of the present invention is in a small discharge state. The flow limit post 42 and the drive gear 41 are disposed coaxially. The center of the top of the recess 12 is provided with a first positioning post 122. The top of the flow limit post 42 is provided with a first positioning hole 422 for receiving the first positioning post 122. The center of the bottom surface of the drive gear 41 is provided with a second positioning post 411 protruding downwardly. The inner bottom wall of the water distribution chamber A is provided with a second positioning hole 23 for receiving the second positioning post 411. The cooperation of the second positioning post 411 and the second positioning hole 23 and the cooperation of the first positioning post 122 and the first positioning hole 422 enable the flow switching member 4 to rotate stably.

It should be noted that the side water inlet 121 is not limited to be located on the side wall of the recess 12 that is disposed on the inner top wall of the water distribution chamber A. The side water inlet 121 may be disposed on the side wall of the water distribution chamber A. Thus, by adjusting the height of the flow limit protruding block 421 on the flow limit post 42, the overlapping area of the flow limit protruding block 421 of the flow limit post 42 and the side water inlet 121 can be increased or decreased when the flow limit post 42 is rotated, so that the flow of the water passing through the water inlet 121 is controlled.

As shown in FIG. 5, FIG. 6, and FIG. 8, when the shower head water-saving switching structure of the present invention is used, the user presses the button 53, the button 53 pushes the swing block 56 to rotate in the forward direction, and the swing block 56 in turn pushes the push rod 52 to move forward to compress the return spring 54. The push rod 52 simultaneously drives the push block 55 to move forward so that the push block 55 engages with the teeth 511 of the ratchet wheel 51 to push the ratchet wheel 51 to rotate in the forward direction. While the ratchet wheel 51 is rotated in the forward direction, the ratchet wheel 51 drives the water distribution gear 31 to rotate synchronously through the rotating shaft 6. At the same time, the water distribution gear 31 drives the drive gear 41 and the flow limit post 42 to rotate. The rotation of the water distribution gear 31 enables the water distribution opening 311 of the water distribution gear 31 to communicate with the different functional water chamber water inlets 22 for switching functional water, thereby controlling the spray mode of the shower head. The rotation of the flow limit post 42 can increase or decrease the overlapping area of the flow limit protruding block 421 and the side water inlet 121 to control the flow of the water passing through the side water inlet 121, thereby controlling the water flow in the water distribution chamber A, so that the discharging flow of the shower head water-saving switching structure of the present invention can be controlled to realize flow switching. When the pressing of the button 53 is completed, the push rod 52 and the push block 55 are moved reversely and returned together by the returning force of the return spring 54. When the push rod 52 is returned, the swing block 56 is pushed to rotate reversely and return. The reverse rotation of the swing block 56 pushes the button 53 to move in the reverse direction. The ratchet wheel 51 won't rotate reversely under the action of the check pawl 57. Thus, the shower head water-saving switching structure of the present invention can drive the functional water switching member 3 to rotate so as to control the water distribution opening 311 of the water distribution gear 31 to communicate with one of the different functional water chamber water inlets 22 by pressing the button 53, thereby realizing the functional water switching function. The flow switching member 4 can be driven to rotate by pressing the button 53 so that the overlapping area of the flow limit protruding block 421 and the side water inlet 121 increases or decreases, thereby controlling the flow of the water passing through the side water inlet 121 to realize the flow switching function. The button is a dual-functional button, so that the shower head water-saving switching structure of the present invention is simplified and the operation is simple. The shower head water-saving switching structure of the present invention controls the flow of the water passing through the side water inlet 121 by means of the cooperation of the flow limit protruding block 421 and the side water inlet 121, thereby controlling the water flow in the water distribution chamber A, so that the discharging flow of the shower head water-saving switching structure of the present invention can be controlled to realize flow switching. Thus, when the influent water flow of the side water inlet 121 is small, the water flow in the water distribution chamber A is correspondingly reduced, so that the effluent water flow of the shower head water-saving switching structure of the present invention is reduced. At this time, the water pressure in the water distribution chamber A does not increase, so that the frictional force applied to the water distribution gear 31 does not increase, and the force required to press the button 53 is not increased. The operation of the shower head water-saving switching structure of the present invention can be more effortless.

Furthermore, the inner bottom wall of the water distribution chamber A is provided with a drain opening 24 communicating with one of the functional water chambers 21. When the overlapping area of the flow limit protruding block 421 of the flow limit post 42 and the side water inlet 121 is the maximum, that is, when the effluent water flow of the shower head water-saving switching structure of the present invention is the minimum, the water distribution opening 311 of the water distribution gear 31 communicates with the drain opening 24, so that the water distribution chamber A can decompress through the drain opening 24, and the force that the button is pressed to drive the functional water switching member 3 and the flow switching member 4 is reduced. Thus, the operation of the shower head water-saving switching structure of the present invention is more effortless.

As shown in FIG. 7 and FIG. 8, the present invention also discloses a shower head, comprising a shower head body 7 and the shower head water-saving switching structure as described above. The shower head body 7 has a head portion 71 and a handle portion 72 connected to the head portion 71. A water inlet pipe 8 is mounted in the handle portion 72. The shower head water-saving switching structure is mounted in the head portion 71 of the shower head body 7. The water inlet passage 11 communicates with the water inlet pipe 8.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A shower head water-saving switching structure, comprising a water inlet seat having a water inlet passage, a water discharging body having a plurality of functional water chambers, a functional water switching member, a flow switching member, and a drive mechanism;

a water distribution chamber being formed between the water inlet seat and the water discharging body, the water distribution chamber being provided with a side water inlet communicating with the water inlet passage; an inner bottom wall of the water distribution chamber being provided with a plurality of functional water chamber water inlets communicating with the respective functional water chambers;

the drive mechanism including a ratchet wheel that is rotatably fitted on a top surface of the water inlet seat, a push rod that is movably fitted on the top surface of the water inlet seat, and a button that is movably fitted on the water inlet seat; the push rod linking and cooperating with the ratchet wheel, a return spring being provided between the push rod and the water inlet seat for moving the push rod to move, the button linking and cooperating with the push rod;

the functional water switching member including a water distribution gear that is rotatably accommodated in the water distribution chamber; the water distribution gear being coaxially connected with the ratchet wheel through a rotating shaft that passes through the water distribution chamber, a bottom surface of the water distribution gear abutting against the inner bottom wall of the water distribution chamber, the water distribution gear being provided with a water distribution opening selectively communicating with one of the functional water chamber water inlets;

the flow switching member including a drive gear that is rotatably accommodated in the water distribution chamber and a flow limit post, the drive gear being meshed with the water distribution gear, the flow limit post being connected to the drive gear, a side wall of the flow limit post being provided with a flow limit protruding block corresponding to the side water inlet;

wherein the drive mechanism drives the water distribution gear to rotate, so that the water distribution opening of the water distribution gear selectively communicates with one of the functional water chamber water inlets; the water distribution gear drives the drive gear and the flow limit post to rotate, so that an overlapping area of the flow limit protruding block of the flow limit post and the side water inlet is increased or decreased, thereby controlling water flow passing through the side water inlet, wherein the functional water switching member and the flow switching member are both in operative coupling with the drive mechanism such that operation of the drive mechanism drives both the functional water switching member and the flow switching member.

2. The shower head water-saving switching structure as claimed in claim 1, wherein an inner top wall of the water distribution chamber is provided with a recess, a side wall of the recess is provided with the side water inlet; the flow limit post is inserted into the recess.

3. The shower head water-saving switching structure as claimed in claim 2, wherein the flow limit post and the drive gear are disposed coaxially, a center of a top of the recess is provided with a first positioning post, a top of the flow limit post is provided with a first positioning hole for receiving the first positioning post, a center of a bottom surface of the drive gear is provided with a second positioning post protruding downwardly, and the inner bottom wall of the water distribution chamber is provided with a second positioning hole for receiving the second positioning post.

4. The shower head water-saving switching structure as claimed in claim 1, wherein a guiding block is formed on the top surface of the water inlet seat, the guiding block is provided with a guiding hole; the push rod is movably inserted through the guiding hole, one side of the push rod is provided with a push block that is movably engaged with teeth of the ratchet wheel, another side of the push rod is provided with a baffle, two ends of the return spring abut against the baffle and the guiding block respectively; the button is hingedly connected to the water inlet seat, a swing block is hingedly connected to the water inlet seat, one end of the swing block abuts against the button, and another end of the swing block abuts against an end of the push rod.

5. The shower head water-saving switching structure as claimed in claim 4, wherein one side of the push rod is provided with a lateral mounting groove, the push block is movably inserted into the lateral mounting groove, and a push block spring is disposed between the push block and a wall of the lateral mounting groove.

6. The shower head water-saving switching structure as claimed in claim 4, wherein one side of the baffle, facing the guiding block, is provided with a protruding post, and the return spring is fitted on the protruding post.

7. The shower head water-saving switching structure as claimed in claim 1, wherein the top surface of the water inlet seat is provided with a check pawl to prevent the ratchet wheel from rotating reversely.

8. The shower head water-saving switching structure as claimed in claim 1, wherein the inner bottom wall of the water distribution chamber is provided with a drain opening communicating with one of the functional water chambers, when the overlapping area of the flow limit protruding block of the flow limit post and the side water inlet is maximum, the water distribution opening of the water distribution gear communicates with the drain opening.

9. A shower head, comprising a shower head body and the shower head water-saving switching structure as claimed in claim 1; the shower head body having a head portion and a handle portion connected to the head portion, a water inlet pipe being mounted in the handle portion, the shower head water-saving switching structure being mounted in the head portion of the shower head body, the water inlet passage communicating with the water inlet pipe.

* * * * *